US007875832B2

(12) United States Patent
Ikeda et al.

(10) Patent No.: US 7,875,832 B2
(45) Date of Patent: Jan. 25, 2011

(54) CERAMIC HEATER, HEAT EXCHANGE UNIT, AND WARM WATER WASHING TOILET SEAT

(75) Inventors: Etsuya Ikeda, Nagoya (JP); Katsuhiko Horii, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 751 days.

(21) Appl. No.: 11/665,010

(22) PCT Filed: Dec. 20, 2005

(86) PCT No.: PCT/JP2005/023354

§ 371 (c)(1),
(2), (4) Date: May 2, 2007

(87) PCT Pub. No.: WO2006/068131

PCT Pub. Date: Jun. 29, 2006

(65) Prior Publication Data

US 2009/0020518 A1 Jan. 22, 2009

(30) Foreign Application Priority Data

Dec. 20, 2004 (JP) ..... 2004-368266

(51) Int. Cl.
*H05B 3/00* (2006.01)

(52) U.S. Cl. ..... 219/217; 219/542; 219/543

(58) Field of Classification Search ..... 219/217, 219/533, 444.1, 541, 542, 543; 165/178; 392/488; 4/444
See application file for complete search history.

(56) References Cited

U.S. PATENT DOCUMENTS 4,035,613 A * 7/1977 Sagawa et al. ..... 219/552
5,916,467 A * 6/1999 Shimada ..... 219/543
6,448,538 B1 * 9/2002 Miyata ..... 219/444.1
2003/0044173 A1 * 3/2003 Natsuhara et al. ..... 392/479
2003/0140407 A1 * 7/2003 Matsumoto et al. ..... 4/420.4

FOREIGN PATENT DOCUMENTS

| | | | |
|---|---|---|---|
| JP | 10-144459 | A | 5/1998 |
| JP | 2000-329407 | A | 11/2000 |
| JP | 2001-135465 | A | 5/2001 |
| JP | 2001-263813 | A | 9/2001 |
| JP | 2001-263814 | A | 9/2001 |
| JP | 2002-372307 | A | 12/2002 |
| JP | 3393798 | B2 | 1/2003 |
| JP | 2004-322121 | A | 11/2004 |

* cited by examiner

*Primary Examiner*—Tu B Hoang
*Assistant Examiner*—John Wasaff
(74) *Attorney, Agent, or Firm*—Sughrue Mion, PLLC

(57) ABSTRACT

A ceramic heater, heat exchange unit, and warm water washing toilet seat are provided having excellent temperature rise characteristics and a shortened heating time to reach a predetermined water temperature. A ceramic heater having a pattern watt density of 50 W/cm$^2$ and above, and a surface watt density of 25 W/cm$^2$ and above has a short start-up time and excellent temperature rise characteristics. Further, the thickness of a core is reduced to between 0.5 mm and 1.9 mm (circular tube thickness is between 1 mm and 2.4 mm), which enables efficient transfer of heat from the ceramic heater to water flowing in the circular tube. Accordingly, a gap between a heat exchanger and the ceramic heater is not necessarily narrowed, such that air bubbles are not likely trapped and breakage of the ceramic heater by thermal shock can be suppressed.

10 Claims, 9 Drawing Sheets

CERAMIC HEATER, HEAT EXCHANGE UNIT, AND WARM WATER WASHING TOILET SEAT

TECHNICAL FIELD

The present invention relates to a ceramic heater and a heat exchange unit for use in, for example, a warm water washing toilet seat, an electric water heater and a 24-hour bath, and a warm washing toilet seat.

BACKGROUND ART

As illustrated in FIG. 11, for example, a conventional warm water washing toilet seat is provided with a heat exchange unit 103 including a resin container (heat exchanger) 101. In order to warm washing water stored in the heat exchanger 101, a ceramic heater 105 in the form of a longitudinal pipe is attached to the heat exchange unit 103.

Since it is necessary to instantaneously change cool water into warm water in this heat exchange unit 103, the ceramic heater 105 used therein has excellent temperature rise characteristics (see Patent Publication 1).

Patent Publication 1: Publication of Japanese Patent No. 3393798 (FIG. 1 and page 2)

DISCLOSURE OF THE INVENTION

Problem to be Solved by the Invention

However, if water held in the aforementioned heat exchanger 101 is a lot, it takes time to raise the water temperature to a predetermined temperature even with the ceramic heater 105 having excellent temperature rise characteristics.

To solve this problem, for example, the inner diameter of the heat exchanger 101 may be reduced so as to reduce the capacity of the heat exchanger 101. In this manner, the water in the heat exchanger 101 can be reduced.

However, if the heat exchanger 101 is made too small, a gap (water passage) 107 narrows between the inner wall of the heat exchanger 101 and the outer wall of the ceramic heater 105. Air bubbles generated on the surface of the ceramic heater 105 may be stuck and stay inside the water passage 107. In that case, a temperature difference increases between the part where the air bubbles are stuck on the ceramic heater 105 and its surroundings. Thermal shock may occur, and the ceramic heater 105 may be damaged.

Consequently, there is limitation to narrow the water passage 107. There is a problem that excellent temperature rise characteristics cannot be achieved.

The present invention was made in view of the above problem. An object of the present invention is to provide a ceramic heater, a heat exchange unit, and a warm water washing toilet seat, which have excellent temperature rise characteristics and enable the time required to reach a predetermined water temperature to be shortened.

Means to Solve the Problem (1) The invention of claim 1 is characterized in that a tubular (e.g., cylindrical) ceramic heater provided with a heating pattern therein for heating a fluid has a pattern watt density of 50 W/cm$^2$ and above.

In the present invention, since the pattern watt density of the ceramic heater is 50 W/cm$^2$ and above, the ceramic heater has a short start-up time (time from the start of operation of the ceramic heater until its attainment to a predetermined temperature) and has excellent temperature rise characteristics, as is clear from a later explained experimental example.

That is, in the present invention, for example, even if the ceramic heater has the same wattage as before, due to the high pattern watt density, reduction in capacity of the container (heat exchanger) storing a fluid, for example, enables the time required until the fluid reaches to a predetermined temperature to be shortened.

Also in the present embodiment, due to the excellent temperature rise characteristics, it is not necessary to excessively narrow a gap between the heat exchanger and the ceramic heater. Air bubbles are not likely to stay in the gap. Thus, the ceramic heater can be restrained from being damaged by thermal shock.

Moreover, there is an advantage that reducing the size of the heat exchanger allows the heat exchange unit to be of compact size as well.

Here, the pattern watt density is, as later explained in detail, ½ of a value of the wattage (not at a start-up time immediately after the power is on but at a stationary time) divided by the area of the heating pattern. The upper limit of the pattern watt density may be, for example, 120 W/cm$^2$.

(2) The invention of claim 2 is characterized in that a tubular (e.g., cylindrical) ceramic heater provided with a heating pattern therein for heating a fluid has a surface watt density of 25 W/cm$^2$ and above.

In the present invention, since the surface watt density of the ceramic heater is 25 W/cm$^2$ and above, the ceramic heater has a short start-up time (time from the start of operation of the ceramic heater until its attainment to a predetermined temperature) and has excellent temperature rise characteristics, as is clear from the later explained experimental example.

That is, in the present invention, for example, even if the ceramic heater has the same wattage as before, due to the high surface watt density, reduction in capacity of the container (heat exchanger) storing a fluid, for example, can shorten the time required until the fluid reaches to a predetermined temperature.

Also in the present embodiment, due to the excellent temperature rise characteristics, it is not necessary to excessively narrow a gap between the heat exchanger and the ceramic heater. Air bubbles are not likely to stay in the gap. Thus, the ceramic heater can be restrained from being damaged by thermal shock.

Moreover, there is an advantage that reducing the size of the heat exchanger allows the heat exchange unit to be of compact size as well.

Here, the surface watt density is, as later explained in detail, ½ of a value of the wattage (not at a start-up time immediately after the power is on but at a stationary time) divided by the area of a heating section where the heating pattern is formed. The upper limit of the surface watt density may be, for example, 60 W/cm$^2$.

(3) The invention of claim 3 is characterized in that a tubular (e.g., cylindrical) ceramic heater provided with a heating pattern therein for heating a fluid has a pattern watt density of 50 W/cm$^2$ and above and has a surface watt density of 25 W/cm$^2$ and above.

The present invention has the operational effects of the aforementioned inventions of claims 1 and 2.

(4) The invention of claim 4 is characterized in that the ceramic heater includes a tubular core member provided inner than the heating pattern and a heating cover member that has the heating pattern and covers an outer surface of the core member.

The present invention exemplifies a structure of the ceramic heater. In the present invention, if the ceramic heater is heated by a current applied to the heating pattern, a fluid flowing through a through hole of the core member (i.e., through hole axially piercing the core member) can be heated via the core member, and a fluid flowing on the outer peripheral side of the heating cover member can be heated via the heating cover member.

(5) The invention of claim 5 is characterized in that a heating section of the heating cover member where the heating pattern is formed is arranged inside a heat exchanger through which the fluid flows.

The present invention exemplifies that the ceramic heater is arranged inside the heat exchanger. Here, the heating section indicates a section of the heating cover member where the heating pattern is formed and its front end side (i.e., opposite side to a back end side where a terminal pattern extending from the heating pattern is formed).

(6) The invention of claim 6 is characterized in that the core member of the ceramic heater has a thickness between 0.5 mm and 1.9 mm.

As shown in the later experimental example, reducing the thickness of the core member of the ceramic heater (i.e., a part of the ceramic heater inner than the position where the heating pattern is provided) to 1.9 mm and below can minimize a temperature difference in a direction of thickness of the core member, as compared to the case of using a thicker core member. Thus, thermal shock can be eased. Also, it is preferable if the thickness of the core member is set to be 0.5 mm and above, since the strength of the core member is enhanced.

(7) The invention of claim 7 is characterized in that the ceramic heater has a thickness between 1 mm and 2.4 mm.

Reducing the thickness of the ceramic heater to 2.4 mm and below allows heat from the heater to be efficiently applied to a fluid (e.g., water) passing through a circular tube, as compared to the case of using a thicker ceramic heater. Thus, thermal shock can be eased even if air bubbles are generated on the surface of the ceramic heater. Also, it is preferable that the ceramic heater has a thickness of 1 mm and above, since the strength of the ceramic heater is enhanced.

(8) The invention of claim 8 is characterized in that the ceramic heater has an axial length (L) between 80 mm and 110 mm.

The present invention exemplifies a desirable axial length of the ceramic heater. That is, adoption of the aforementioned pattern watt density and surface watt density allows the axial length of the ceramic heater to be shorter than before. Since the capacity of the heat exchanger can be reduced by shortening the axial length of the heat exchanger, the fluid can be promptly heated with the ceramic heater.

An axial length (A) of the heating section may be ⅔ of a range from 80 to 110 mm.

(9) The invention of claim 9 is characterized in that the ceramic heater has an outer diameter between 8 mm and 15 mm.

The present invention exemplifies a desirable size of the outer diameter of the ceramic heater. That is, adoption of the aforementioned pattern watt density and surface watt density allows the outer diameter of the ceramic heater to be smaller than before. Since the capacity of the heat exchanger can be reduced by reducing the inner diameter of the heat exchanger, the fluid can be promptly heated with the ceramic heater.

(10) The invention of claim 10 is a heat exchange unit including the ceramic heater according to one of claims 1 to 9 which is attached to a heat exchanger through which the fluid flows.

The present invention exemplifies the heat exchange unit provided with the aforementioned ceramic heater.

(11) The eleventh aspect of the invention is characterized in that a flow passage is provided from a through hole that axially pierces the ceramic heater to a gap on an outer peripheral side of the ceramic heater as a flow passage of the fluid in the heat exchange unit.

The present invention indicates the flow passage of the fluid in the heat exchange unit. In the present invention, the fluid is let flow from a gap on the inner peripheral side of the ceramic heater (i.e., through hole) to a gap on the outer peripheral side of the ceramic heater (i.e., gap between the outer peripheral surface of the ceramic heater and the inner peripheral surface of the heat exchange unit) to efficiently heat the fluid.

(12) The twelfth aspect of the invention is a warm water washing toilet seat including the heat exchange unit according to the tenth or eleventh aspect.

The present invention exemplifies the warm water washing toilet seat including the aforementioned heat exchange unit.

It is preferable that the capacity of the container constituting the heat exchanger is in a range from 15 to 25 $cm^3$ in case that the volume of the ceramic heater is included, and from 10 to 20 $cm^3$ in case that the volume of the ceramic heater is excluded (in the case of only the amount of water is included). Here, if the capacity of the heat exchanger is equal to the lower limit or above, there is less fear that the ceramic heater may be damaged by thermal shock, etc. If the capacity of the heat exchanger is equal to the upper limit or below, heating characteristics of the ceramic heater is excellent and ideal.

The rate of flow of the liquid that flows into and out of the heat exchanger can be in a range from 300 to 1000 ml/min.

Moreover, the size of the gap between the inner wall (inner peripheral surface) of the heat exchanger and the outer wall (outer peripheral surface) of the ceramic heater can be in a range from 1 to 5 mm.

The temperature difference before and after heating the fluid can be in a range from 20 to 45° C.

EXPLANATION OF REFERENCES

Figure 1A:
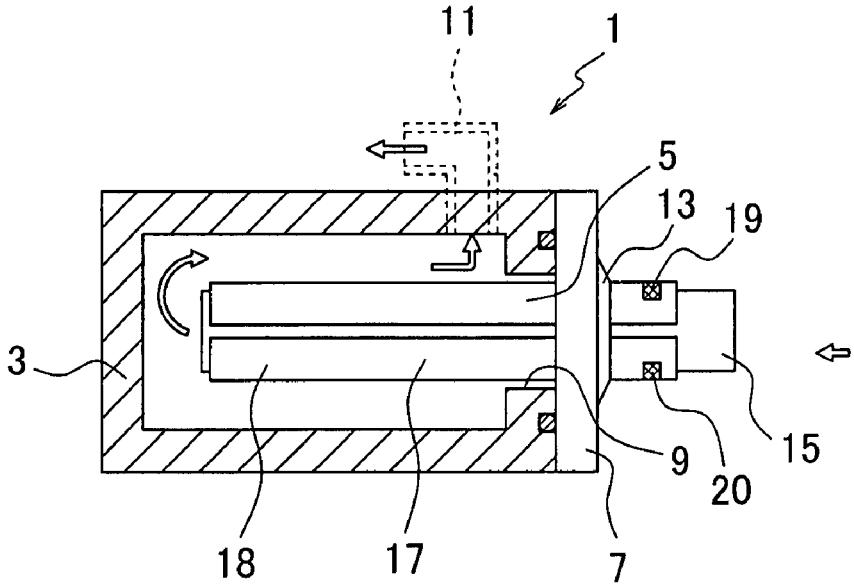
FIGS. 1(*a*) is an explanatory cross sectional view of a heat exchange unit of Embodiment 1, and (*b*) is a side view showing a ceramic heater in an axial direction.

1, 31, 41, 51 . . . heat exchange unit
3, 33, 43, 53 . . . heat exchanger
5, 35, 45, 55 . . . ceramic heater
7 . . . flange
15, 34, 47, 57 . . . core member
16 . . . ceramic substrate
17, 36, 49, 59 . . . heating cover member
21 . . . heating pattern

BEST MODE FOR CARRYING OUT THE INVENTION

Now, examples (embodiments) of the best mode of the present invention will be described.

Embodiment 1 a) Firstly, a ceramic heater and a heat exchange unit of the present embodiment will be described.

The heat exchange unit of the present embodiment is for use in heating washing water in a warm water washing toilet seat.

Figure 1B:
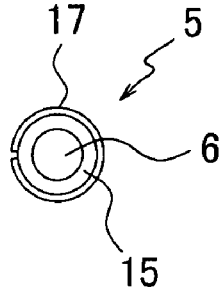

As shown in FIGS. 1(*a*) and (*b*), the heat exchange unit 1 includes a heat exchanger 3 that stores washing water, a ceramic heater 5 that is attached to the heat exchanger 3 and heats the washing water, and a fixing member (flange) 7 that secures the ceramic heater 5 to the heat exchanger 3. The ceramic heater 5 is arranged coaxially with the heat exchanger 3.

The heat exchanger 3 is a bottomed cylindrical container (of inner diameter ϕ 19 mm×outer diameter ϕ 30 mm×axial length (external size) 70 mm). The heat exchanger 3 is, for example, made of resin such as glass added nylon. On one axial end of the heat exchanger 3 (right side in FIG. 1(*a*); back end side), a circular opening 9 is formed into which the ceramic heater 5 is inserted. On a radial side surface of the back end side, a pipe-shaped outlet (dotted line in FIG. 1(*a*)) 11 is provided out of which washing water flows.

The flange 7 is a disk-shaped member made of alumina. The ceramic heater 5 extends through the center of the flange 7. The ceramic heater 5 is fixed to the flange 7 and sealed with a glass adhesive 13.

The ceramic heater 5 is a pipe-shaped cylindrical member (of inner diameter ϕ 6.6 mm×outer diameter ϕ 11.5 mm×axial length 85 mm) made of alumina. The ceramic heater 5 is provided with a cylindrical core member 15 (having a thickness of approximately 1.9 mm) made of alumina, and a heating cover member 17 (having a thickness of 0.5 mm) made of alumina that is formed to cover the outer peripheral surface of the core member 15.

Figure 2A:
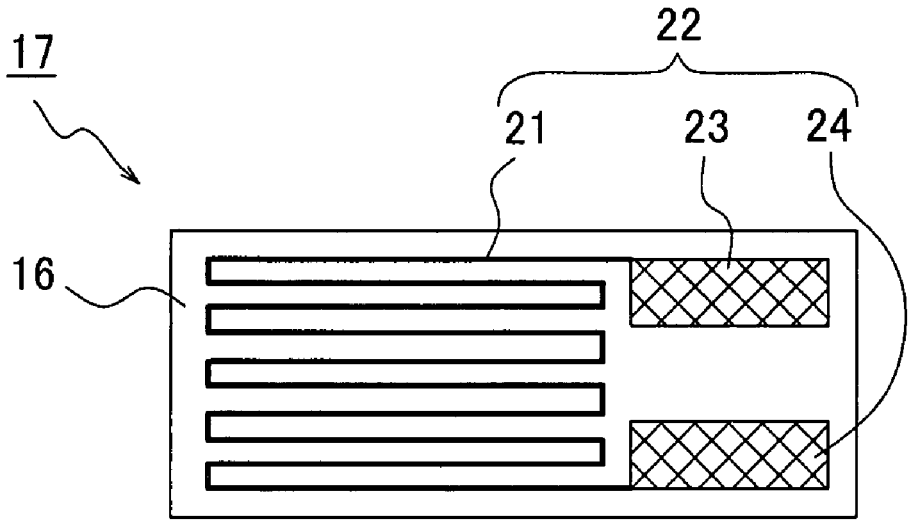
FIGS. 2(*a*) and (*b*) are explanatory developed views showing a conductive pattern of a heating cover member of Embodiment 1.
Figure 2B:
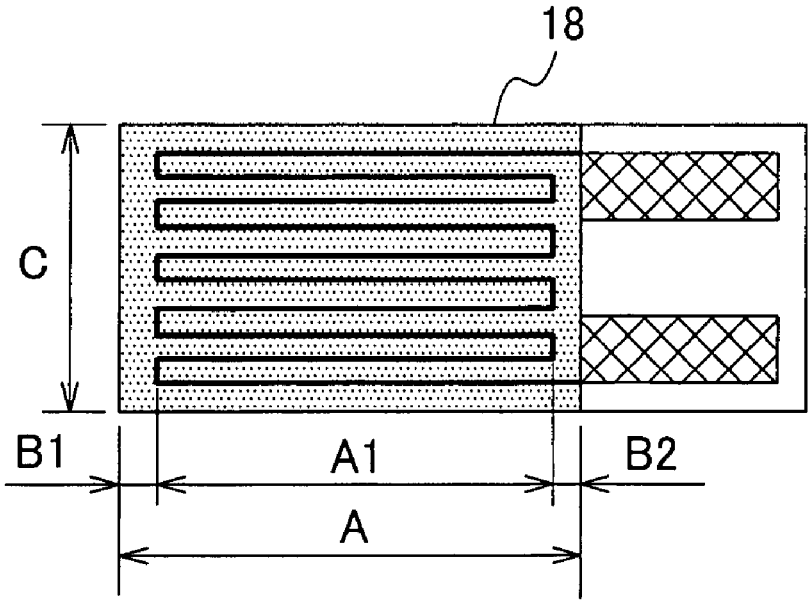

The front end side of the ceramic heater 5, that is, the side of a heating section 18 where a heating pattern 21 is formed (see FIGS. 2(*a*) and (*b*)), is arranged inside the heat exchanger 3. The back end side of the ceramic heater 5 protrudes outward from the heat exchanger 3.

On the surface on the back end side of the ceramic heater 5, a pair of external terminal patterns 19 and 20 are formed. The external terminal patterns 19 and 20 are electrically connected to their respective terminal patterns 23 and 24 (see FIGS. 2(*a*) and (*b*)) via not shown through holes.

As shown in FIG. 2(*a*) in which the heating cover member 17 is developed to show the side of the core member 15, the heating cover member 17 is a thin ceramic substrate 16 made of alumina, on the surface of which a conductive pattern 22 is formed on the side of the core member 15. The conductive pattern 22 is made of high melting point metal, for example, of Mo and W (weight ratio of W:Mo=2:3). The conductive pattern 22 includes a meandering heating pattern 21 on the front end side (left side in FIG. 2(*a*)) and a pair of terminal patterns 23 and 24 on the back end side. The meandering heating pattern 21 generates heat by application of current. The terminal patterns 23 and 24 are connected to the heating pattern 21. Resistance of the heating pattern 21 is equal to 6Ω. The heating pattern 21 has a line width of approximately 0.6 mm, and a thickness of 20 to 35 μm.

Particularly in the present embodiment, a pattern area is set such that a pattern watt density is equal to 68 W/cm$^2$, since the ceramic heater 5 is used which has a power consumption (at a stationary time) of 1200 W.

The pattern watt density is defined as in the following equation (1).

$$\text{pattern watt density [W/cm}^2\text{]}=\text{power consumption [W]}\div\text{pattern area [cm}^2\text{]}\div 2 \quad (1)$$

In this equation (1), the pattern area is a surface area of the heating pattern 21. Since the pattern area is set to be 8.8 cm$^2$, the pattern watt density is 1200 W÷8.8 cm$^2$÷2=68 W/cm$^2$.

Also in the present embodiment, the surface watt density is defined as in the following equation (2).

$$\text{surface watt density [W/cm}^2\text{]}=\text{power consumption [W]}\div\text{heating section surface area [cm}^2\text{]}\div 2 \quad (2)$$

In this equation (2), the heating section surface area is a surface area of the section on the front end side (heating section 18) of the heating cover member 17 where the heating pattern 21 exists. Here, the heating section surface area indicates an area on the front end side of the surface area of the developed heating cover member 17, in case that heating cover member 17 is divided into two sections, that is, the side where the heating pattern 21 exists and the side where the terminal patterns 23 and 24 exist, by a straight line which connects both front end sides (where the heating pattern 21 exists) of the terminal patterns 23 and 24.

Particularly, as shown in FIG. 2(*b*), the heating section surface area (gray section shown with dots in FIG. 2(*b*)) is set to be C×(A1+B1+B2)=3.3 cm×(4.7 cm+0.2 cm+0.3 cm)=17.1 cm$^2$. Thus, the surface watt density is equal to 1200 W÷17.1 cm$^2$÷2=35 W/cm$^2$.

The above "C" represents a longitudinal length of the developed heating cover member 17 in FIG. 2(*b*). "A1" represents a lateral length of the meandering section of the heating pattern 21. "B1" represents a length from the front end of the meandering section of the heating pattern 21 to the front end of the heating cover member 17. "B2" is a length from the back end of the meandering section of the heating pattern 21 to the front ends of the terminal patterns 23 and 24. "A" is equal to (A1+B1+B2).

Figure 3A:
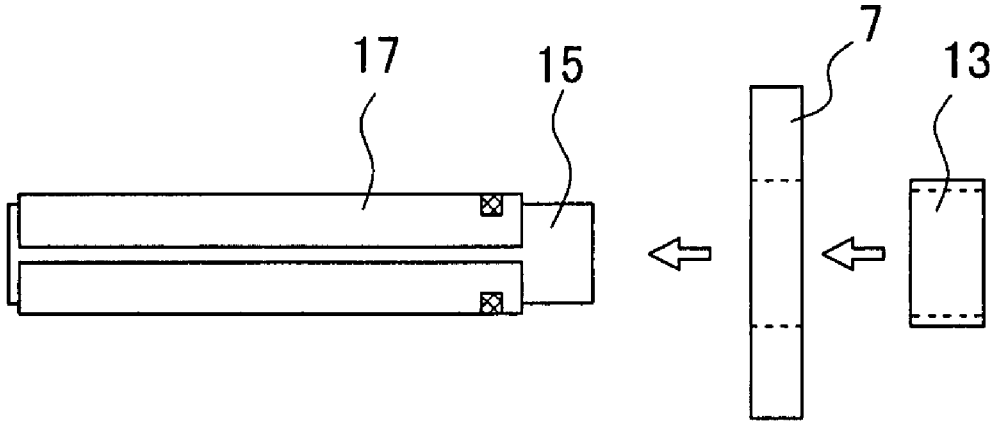
FIGS. 3(*a*) and (*b*) are explanatory views showing a manufacturing method of the heat exchange unit of Embodiment 1.
Figure 3B:
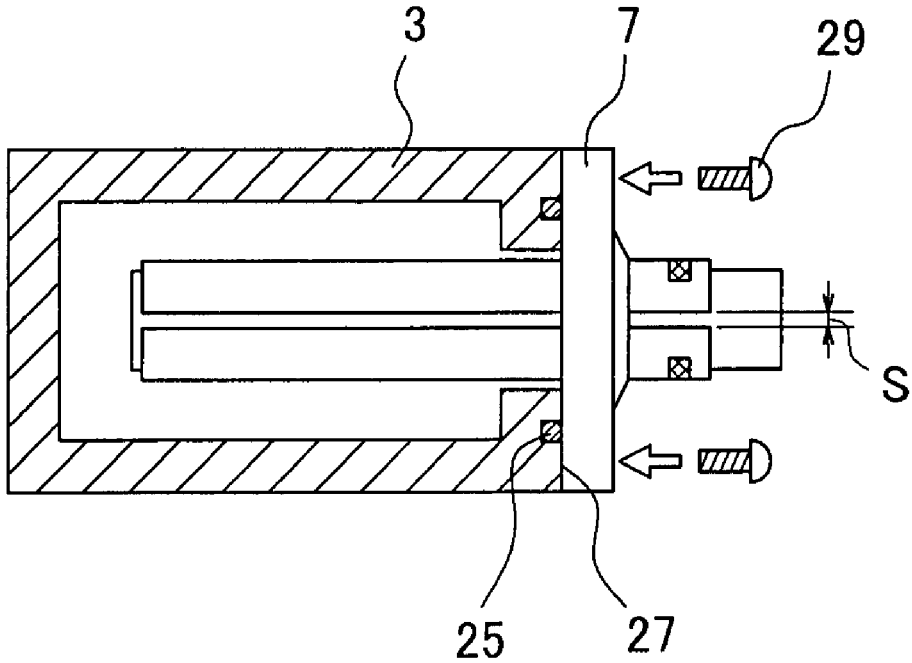

The above "C" can be calculated by an expression {(outer diameter of the heating cover member−outer diameter of the core member)×π−size s (see FIG. 3(*b*)) of a slit between the ends of the wound heating cover member}. Accordingly, C={(11.5 mm−10.4 mm)×π−1 mm}≈33.4 mm≈approximately 3.3 cm.

Here, the capacity of the heat exchanger 3 is about 17 $cm^3$ in case that the volume of the ceramic heater 5 is included. In case that the volume of the ceramic heater 5 is not included, the capacity of the heat exchanger 3 is about 13 $cm^3$. Also, the rate of flow of washing water which flows into and out of the heat exchanger 3 is 430 ml/min. The size of a gap between the inner wall (inner peripheral surface) of the heat exchanger 3 and the outer wall (outer peripheral surface) of the ceramic heater 5 is about 3.5 mm.

Accordingly, as shown in FIG. 1(*a*), in the heating exchanger unit 1 having the above constitution, when tap water having a temperature of 5° C., for example, is introduced as shown with arrows, the tap water flows into an inner through hole 6 from the back end side of the ceramic heater 5 and flows out from the front end side.

The tap water, when passing the through hole 6, is heated by the ceramic heater 5 to have a rise in temperature. Tap water around the ceramic heater 5 is also heated by the ceramic heater 5 to have a temperature rise, for example, of 30° C., and supplied from the heat exchanger 3 through an outlet 11 as warm washing water.

b) Next, a manufacturing method of the heat exchange unit 1 of the present embodiment will be described.

First of all, a pipe-shaped alumina ceramic substrate (core member 15) is formed by calcination. Paste including high melting point metal of Mo and W is printed on the surface of an alumina ceramic sheet so as to form patterns which will be the heating pattern 21 and the terminal pattern 23.

Next, ceramic paste (alumina paste) is applied to the ceramic sheet. The ceramic sheet is wound and adhered to the outer peripheral surface of the core member 15 and calcined. Thereby, as shown in FIG. 3(*a*), the ceramic heater 5 is obtained in the form that the heating cover member 17 is wound around the core member 15.

Next, the ceramic flange 7 is attached at a predetermined attachment position on the back end side (right side in FIG. 3(*a*)) of the ceramic heater 5. The ceramic heater 5 and the flange 7 are adhered by a ring-shaped glass adhesive 13 or the like disposed therebetween, and are bonded to the ceramic heater 5.

Next, as shown in FIG. 3(*b*), the front end side (left side in FIG. 3(*b*)) of the ceramic heater 5 with the flange 7 is inserted to the heat exchanger 3. The flange 7 is made abut on an open end 27 of the heat exchanger 3 using a seal member 25 such as an O-ring. The flange 7 is secured by a screw 29 to finish the heat exchange unit 1 composed of the ceramic heater 5 and the heat exchanger 3.

c) As above, in the present embodiment, the pattern watt density is 50 W/$cm^2$ and above and the surface watt density is 25 W/$cm^2$ and above. Accordingly, as is clear from a later explained experimental example, the present embodiment has an effect that a short start-up time (time from the start of operation of the ceramic heater until its attainment to a predetermined temperature) and excellent temperature rise characteristics are achieved.

That is, even if the ceramic heater 5 has the same wattage as before, due to the high pattern watt density and surface watt density, reduction in capacity of the heat exchanger 3 can shorten the time required until washing water reaches to a predetermined temperature (e.g., 35° C.) from room temperature. Also in the present embodiment, due to the excellent temperature rise characteristics, it is not necessary to excessively narrow a gap between the heat exchanger 3 and the ceramic heater 5. Air bubbles are unlikely to stay in the gap. Thus, the ceramic heater 5 can be restrained from being damaged by thermal shock.

Also in the present embodiment, since the axial length of the ceramic heater 5 is in a range from 80 to 110 mm, the axial length of the heat exchanger 3 can be shortened as compared to before so as to reduce the capacity of the heat exchanger 3. Accordingly, the washing water can be promptly heated.

Moreover, there is an advantage that reducing the size of the heat exchanger 3 allows the heat exchange unit 1 to be of compact size as well.

Embodiment 2

Embodiment 2 will be described hereinafter. However, explanation of the same contents as Embodiment 1 will be omitted.

Figure 4A:
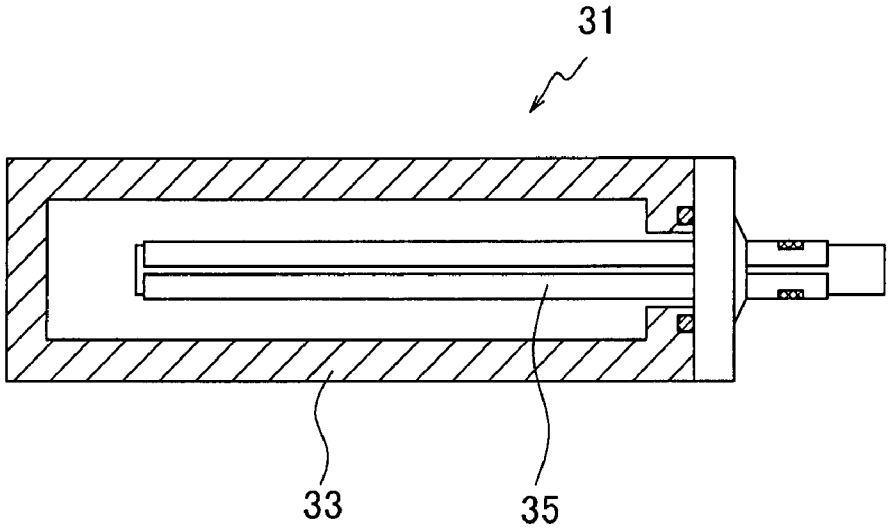
FIGS. 4(*a*) is an explanatory cross sectional view of a heat exchange unit of Embodiment 2, and (*b*) is a side view showing a ceramic heater in an axial direction.
Figure 4B:
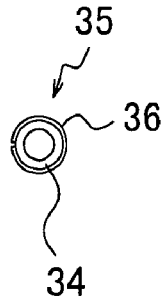

As shown in FIGS. 4(*a*) and (*b*), in a heat exchange unit 31 of the present embodiment, a heat exchanger 33 is axially long and radially short as compared to the heat exchange unit 1 of Embodiment 1. Correspondingly, a ceramic heater 35 is axially long and radially short.

Particularly, the heat exchanger 33 has a size of inner diameter of ϕ 15 mm×outer diameter ϕ 30 mm×axial length (external size) 100 mm. The ceramic heater 35 has a size of inner diameter ϕ 3.2 mm×outer diameter ϕ 8 mm×axial length (external size) 110 mm. The core member 34 has a thickness of about 1.9 mm. The heating cover member 36 has a thickness of about 0.5 mm.

The heat exchanger 33 has a capacity of about 16 $cm^3$ in case that the volume of the ceramic heater 35 is included, and about 12 $cm^3$ in case that the volume of the ceramic heater 35 is not included. The rate of flow of washing water which flows into and out of the heat exchanger 33 is 430 ml/min. The size of a gap between the inner wall (inner peripheral surface) of the heat exchanger 33 and the outer wall (outer peripheral surface) of the ceramic heater 35 is about 3.5 min.

Furthermore, the pattern watt density is 52 W/$cm^2$ and the surface watt density is 34 W/$cm^2$.

In the present embodiment, the above sizes and characteristics can produce the same effect as Embodiment 1.

Particularly in the present embodiment, the ceramic heater 35 has an outer diameter within a range from 8 to 15 mm, which is smaller than before. Accordingly, the heat exchanger 33 can have a reduced inner diameter and the heat exchanger 33 can have a reduced capacity. Thus, prompt heating of the washing water can be achieved. Also, the heat exchanger 33 can have a reduced outer diameter. There is an advantage that the overall heat exchange unit 31 can be of compact size.

Embodiment 3

Embodiment 3 will be described hereinafter. However, explanation of the same contents as Embodiment 1 will be omitted.

Figure 5A:
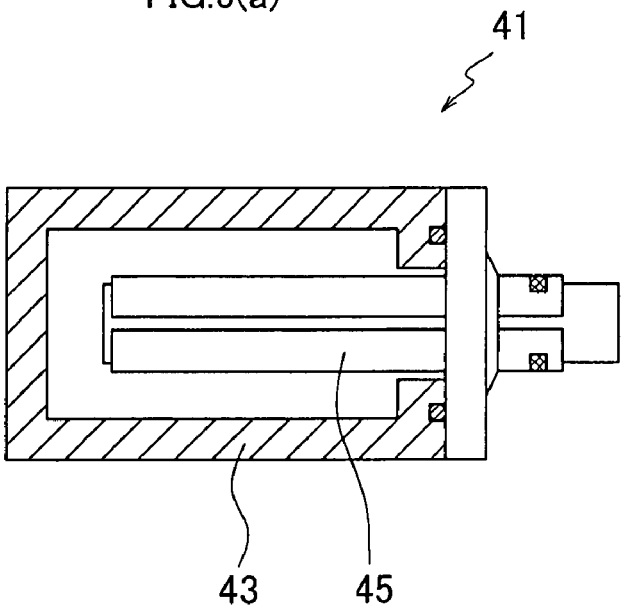
FIGS. 5(*a*) is an explanatory cross sectional view of a heat exchange unit of Embodiment 3, and (*b*) is a side view showing a ceramic heater in an axial direction.
Figure 5B:
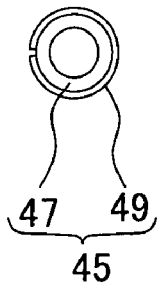

As shown in FIGS. 5(*a*) and (*b*), a heat exchange unit 41 of the present embodiment has the same shape but a thinner ceramic heater 45 than the heat exchange unit 1 of Embodiment 1.

Particularly, a heat exchanger 43 has a size of inner diameter of ϕ 19 mm×outer diameter ϕ 30 mm×axial length (external size) 70 mm. The ceramic heater 45 has a size of ϕ 8.5 mm×outer diameter ϕ 11.5 mm×axial length (external size) 85 mm.

The ceramic heater 45 has a thin wall of 1.5 mm. This is because a core member 47 has a thickness of 1.0 mm, which is thinner than the core member 7 of Embodiment 1 (a heating cover member 49 has the same thickness of 0.5 mm as Embodiment 1).

Also, the heat exchanger 43 has a capacity of about 17 $cm^3$ in case that the volume of the ceramic heater 45 is included, and about 14 $cm^3$ in case that the volume of the ceramic heater 45 is not included. The rate of flow of washing water which flows into and out of the heat exchanger 43 is 430 ml/min. The size of a gap between the inner wall (inner peripheral surface) of the heat exchanger 43 and the outer wall (outer peripheral surface) of the ceramic heater 45 is about 3.5 mm.

Furthermore, the pattern watt density is 68 $W/cm^2$ and the surface watt density is 35 $W/cm^2$.

In the present embodiment, the above sizes and characteristics can produce the same effect as Embodiment 1. Due to the thin wall (within a range from 0.5 mm to 1.9 mm) of the core member 47, even if air bubbles are generated at the time of heating, thermal shock is unlikely to occur. Therefore, there is an advantage that any damage which may be caused by thermal shock can be inhibited.

Embodiment 4

Embodiment 4 will be described hereinafter. However, explanation of the same contents as Embodiment 2 will be omitted.

Figure 6A:
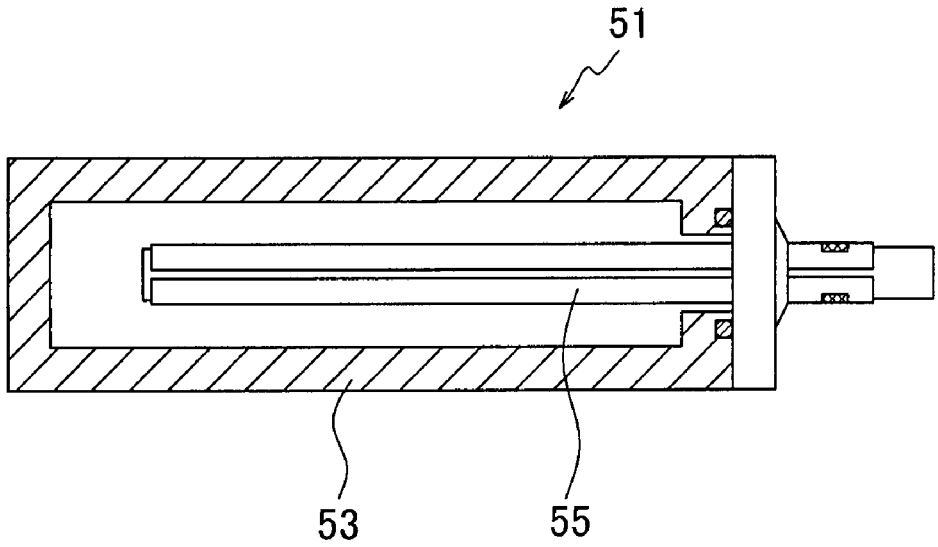
FIGS. 6(*a*) is an explanatory cross sectional view of a heat exchange unit of Embodiment 4, and (*b*) is a side view showing a ceramic heater in an axial direction.
Figure 6B:
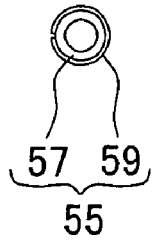

As shown in FIGS. 6(*a*) and (*b*), a heat exchange unit 51 of the present embodiment has the same shape but a thinner ceramic heater 55 than the heat exchange unit 31 of Embodiment 2.

Particularly, a heat exchanger 53 has a size of inner diameter of ϕ 15 mm×outer diameter ϕ 30 mm×axial length (external size) 100 mm. The ceramic heater 55 has a size of ϕ 5 mm×outer diameter ϕ 8 mm×axial length (external size) 110 mm.

The ceramic heater 55 has a thin wall of 1.5 mm. This is because a core member 57 has a thickness of 1.0 mm, which is thinner than the core member 37 of Embodiment 2. A heating cover member 59 has a thickness of about 0.5 mm which is the same as the heat covering member 39 in Embodiment 2.

The heat exchanger 53 has a capacity of about 16 $cm^3$ in case that the volume of the ceramic heater 55 is included, and about 13 $cm^3$ in case that the volume of the ceramic heater 55 is not included. The rate of flow of washing water which flows into and out of the heat exchanger 53 is 430 ml/min. The size of a gap between the inner wall (inner peripheral surface) of the heat exchanger 53 and the outer wall (outer peripheral surface) of the ceramic heater 55 is about 3.5 mm.

Furthermore, the pattern watt density is 52 $W/cm^2$ and the surface watt density is 34 $W/cm^2$.

In the present embodiment, the above sizes and characteristics can produce the same effect as Embodiment 2. Since the core member 57 (and thus the ceramic heater 55) has the thin wall, heat from the ceramic heater 5 can be efficiently transmitted to water passing through the circular tube. Even if air bubbles are generated at the time of heating, thermal shock is unlikely to occur. Therefore, there is an advantage that any damage which may be caused by thermal shock can be inhibited.

Experimental Example 1

Now, Experimental example 1 will be described which was performed to confirm the effects of the present invention.

In the present experimental example, a ceramic heater in various sizes and a heat exchange unit using the ceramic heater were manufactured to investigate heat exchange performance.

Figure 7A:
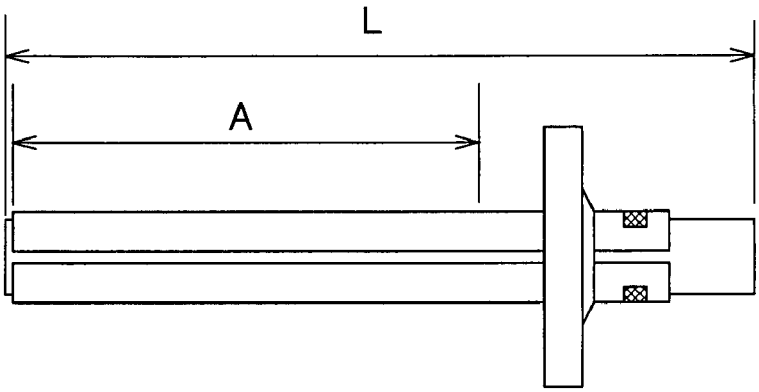
FIGS. 7(*a*) is a front view of a ceramic heater (with a flange) of Sample 1 for use in an experiment, (*b*) is a side view of the ceramic heater (without the flange), and (*c*) is an explanatory cross sectional view of a heat exchange unit.
Figure 7B:
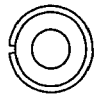
Figure 7C:
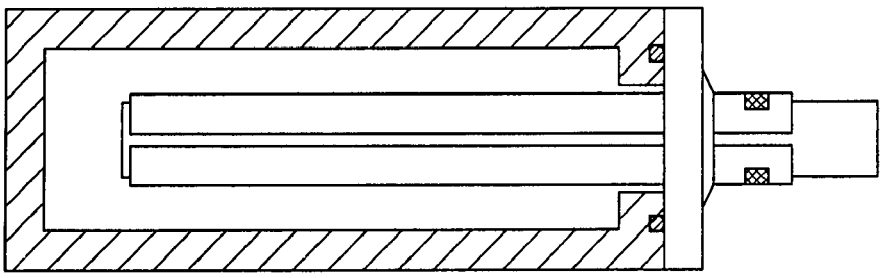
Figure 8A:
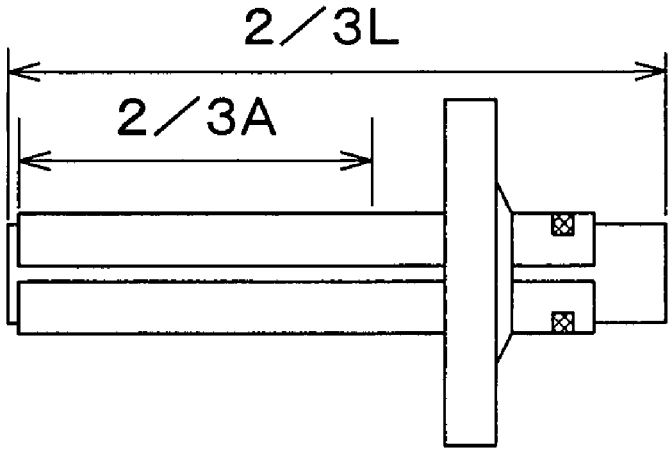
FIGS. 8(*a*) is a front view of a ceramic heater (with a flange) of Sample 2 for use in the experiment, (*b*) is a side view of the ceramic heater (without the flange), and (*c*) is an explanatory cross sectional view of a heat exchange unit.
Figure 8B:
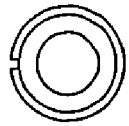
Figure 8C:
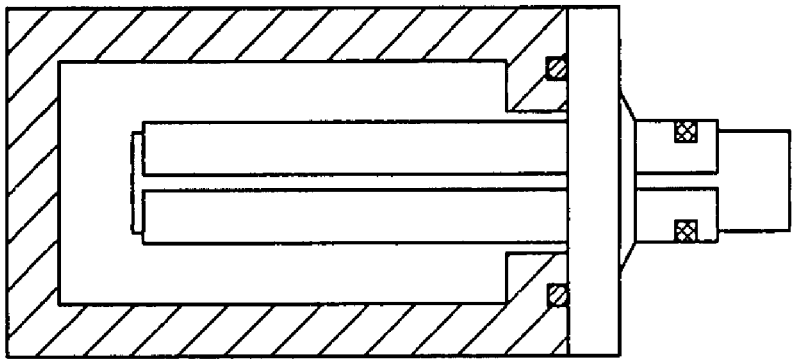
Figure 9A:
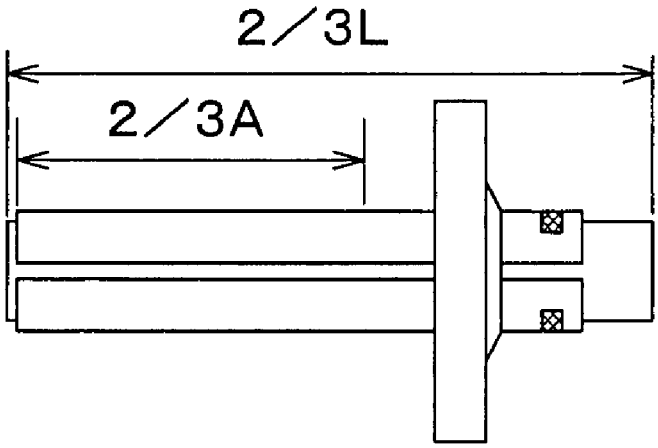
FIGS. 9(*a*) is a front view of a ceramic heater (with a flange) of Sample 3 for use in the experiment, (*b*) is a side view of the ceramic heater (without the flange), and (*c*) is an explanatory cross sectional view of a heat exchange unit.
Figure 9B:
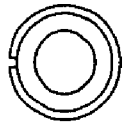
Figure 9C:
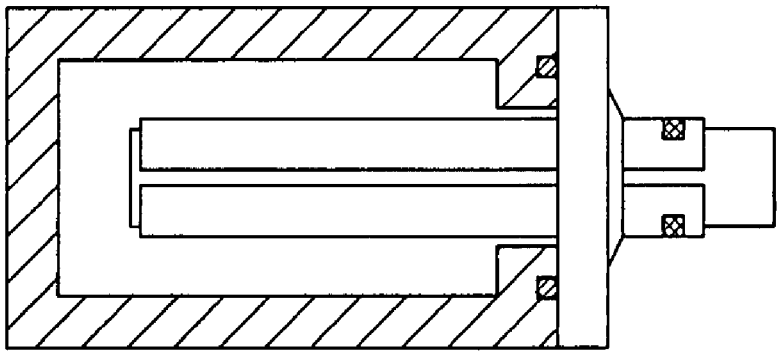
Figure 10A:
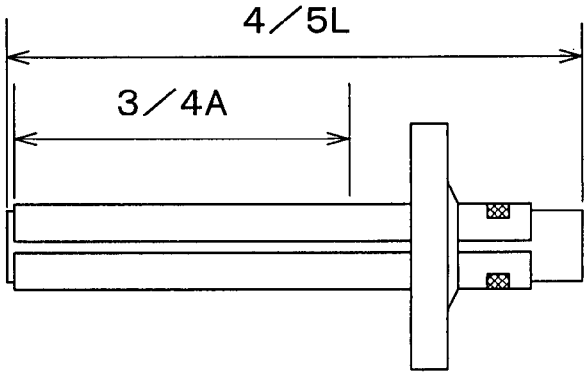
FIGS. 10(*a*) is a front view of a ceramic heater (with a flange) of Sample 4 for use in the experiment, (*b*) is a side view of the ceramic heater (without the flange), and (*c*) is an explanatory cross sectional view of a heat exchange unit.
Figure 10B:
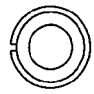
Figure 10C:
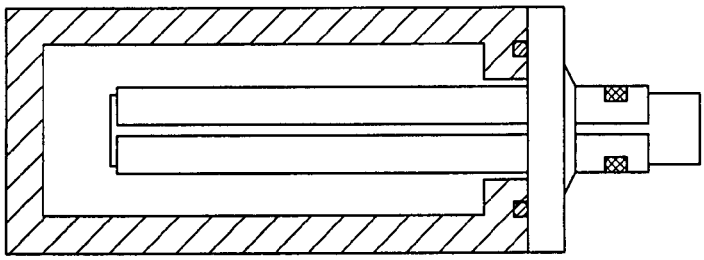
Figure 11:
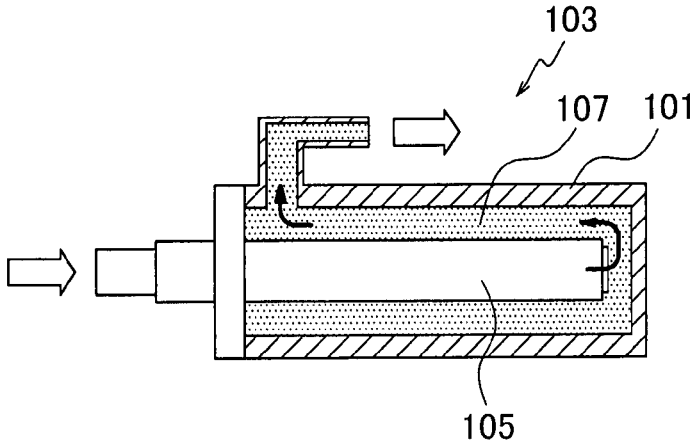
FIG. 11 is an explanatory cross sectional view of a conventional heat exchange unit.

A conventional heat exchange unit as shown in FIGS. 7(*a*) to (*c*) was manufactured as a sample 1 of a comparative example for use in the experiment. A heat exchange unit identical to that of Embodiment 1 as shown in FIGS. 8(*a*) to (*c*) was manufactured as a sample 2 of the present invention. A heat exchange unit identical to that of Embodiment 3 as shown in FIGS. 9(*a*) to (*c*) (i.e., the core member is thinner than that of Embodiment 1) was manufactured as a sample 3 of the present invention. A heat exchange unit which has a ceramic heater axially shorter than the sample 1 and longer than the samples 2 and 3 as shown in FIGS. 10(*a*) to (*c*) was manufactured as a sample 4 of the present invention.

A particular relationship in size, etc. among the respective samples is shown in the following Table 1.

TABLE 1

| | Comp. Ex. | Examples of the invention | | |
|---|---|---|---|---|
| | Sample 1 | Sample 2 | Sample 3 | Sample 4 |
| Ceramic heater length | L (117 [mm]) | (2/3)L | (2/3)L | (4/5)L |
| Ceramic heater outer diameter | F (11.5 [mm]) | F | F | F |
| Ceramic heater thickness | D1 (2.5 [mm]) | 2.4 [mm] | 1.8 [mm] | 1.8 [mm] |
| Core member thickness | D2 (2.0 [mm]) | 1.9 [mm] | 1.3 [mm] | 1.3 [mm] |
| Heating covering member thickness | d (0.5 [mm]) | 0.5 [mm] | 0.5 [mm] | 0.5 [mm] |
| Heating section size | A (82 [mm]) | (2/3)A | (2/3)A | (3/4)A |
| Pattern watt density | 42 [$W/cm^2$] | 68 [$W/cm^2$] | 68 [$W/cm^2$] | 51 [$W/cm^2$] |
| Surface watt density | 22 [$W/cm^2$] | 35 [$W/cm^2$] | 35 [$W/cm^2$] | 29 [$W/cm^2$] |
| Heating exchanger capacity (water volume) | 22 [$cm^3$] | 13 [$cm^3$] | 14 [$cm^3$] | 16 [$cm^3$] |

Tap water having the following temperature was let flow to each sample at the following flow rate. The ceramic heater was set to be 1200 W at a stationary time. Then, the time to attain a predetermined temperature, i.e., start-up time (start-up time until attainment of rise of 30° C.), was measured. The results, etc. are shown in the following Table 2.

TABLE 2

| | Comp. Ex. | Examples of the invention | | |
|---|---|---|---|---|
| | Sample 1 | Sample 2 | Sample 3 | Sample 4 |
| Input water temperature | 5 [° C.] | 5 [° C.] | 5 [° C.] | 5 [° C.] |
| Output water Temperature | 35 [° C.] | 35 [° C.] | 35 [° C.] | 35 [° C.] |
| Flow rate | 430 [ml/min] | 430 [ml/min] | 430 [ml/min] | 430 [ml/min] |
| Start-up time | 10.6 [sec.] | 8.1 [sec.] | 7.9 [sec.] | 8.4 [sec.] |

As is clear from Table 2, the samples 2, 3 and 4 in the scope of the present invention have especially short start-up time.

Thus, it was found that the samples 2, 3 and 4 are excellent in temperature rise characteristics.

Experimental Example 2

Experimental example 2 will be described hereinafter.

Investigated in the present experimental example was a change in thermal shock resistance of the ceramic heater, depending on the thickness of the core member.

In the present experimental example, a sample 5 was manufactured as a sample having a thick core member. The sample 5 includes a ceramic heater having a length of 85 mm, an outer diameter of 11.5 mm, and a thickness of 2.5 mm, and a core member having a thickness of 2.0 mm. Also, a sample 6 was manufactured as a sample having a thin core member. The sample 6 includes a ceramic heater having a length of 85 mm, an outer diameter of 11.5 mm, and a thickness of 1.8 mm, and a core member having a thickness of 1.3 mm. Each ceramic heater was attached to a heat exchanger to constitute a heat exchange unit, respectively. Vacuum grease was applied to a part of the surface of the ceramic heater to shed water.

Tap water was let flow to each heat exchange unit. The power consumption of the ceramic heater was set to be 1800 W. Current was applied to the ceramic heater for 5 minutes. Other conditions were set to be the same as in the case of the sample 2.

As a result, a crack was generated in the sample 5 having the core member of 2.0 mm thickness. There was no crack in the sample 6 having the core member of 1.3 mm thickness.

Accordingly, it was found, from this experiment, that the thinner the core member is, the more excellent thermal shock resistance the ceramic heater has.

The present invention should not be limited to the above described embodiments, but may be practiced in various manners without departing from the scope of the present invention.

The invention claimed is:

1. A tubular ceramic heater comprising a heating pattern therein for heating a liquid, wherein a tubular core member having a water passage is provided on an inner side of the heating pattern;

the ceramic heater heats a liquid which flows in a through hole of the tubular core member;

wherein the ceramic heater has a pattern watt density of from 50-120 W/cm$^2$ and a surface watt density of from 25-60 W/cm$^2$, wherein the volume of the water passage is between 10 to 20 cm$^3$, and wherein a distance in a radial direction between an outer wall of the heating section of the ceramic heater and an outer wall of a path is between 1 to 5 mm.

2. The ceramic heater according to claim 1 further comprising:

a heating cover member that has the heating pattern and covers an outer surface of the core member.

3. The ceramic heater according to claim 1 wherein a heating section of the heating cover member where the heating pattern is formed is arranged inside a path of a heat exchanger through which the liquid flows.

4. The ceramic heater according to claim 1 wherein the core member of the ceramic heater has a thickness between 0.5 mm and 1.9 mm.

5. The ceramic heater according to claim 1 wherein the ceramic heater has a thickness between 1 mm and 2.4 mm.

6. The ceramic heater according to claim 1 wherein the ceramic heater has an axial length between 80 mm and 110 mm.

7. The ceramic heater according to claim 1 wherein the ceramic heater has an outer diameter between 8 mm and 15 mm.

8. A heat exchange unit including the ceramic heater according to claim 1 which is attached to a heat exchanger through which the liquid flows.

9. The heat exchange unit according to claim 8 wherein a flow passage is provided from a through hole that axially pierces the ceramic heater to a gap on an outer peripheral side of the ceramic heater as a flow passage of the liquid in the heat exchange unit, wherein the ceramic heater protrudes into an interior of the heat exchanger through which the liquid flows, and the flow passage is defined by a gap between an inner wall of the heat exchanger and an outer wall of the ceramic heater.

10. A warm water washing toilet seat comprising the heat exchange unit according to claim 8.

* * * * *